United States Patent [19]

Appelbaum

[11] Patent Number: 4,905,486

[45] Date of Patent: Mar. 6, 1990

[54] LOCKABLE SECURITY COVER FOR A PADLOCK

[76] Inventor: Paul Appelbaum, Box 27006, Denver, Colo. 80227

[21] Appl. No.: 303,296

[22] Filed: Jan. 30, 1989

[51] Int. Cl.[4] ..... E05B 67/38

[52] U.S. Cl. ..... 70/54; 70/55; 70/417

[58] Field of Search ..... 70/54–56, 70/417, 52

[56] References Cited

U.S. PATENT DOCUMENTS

| | | | |
|---|---|---|---|
| 1,291,993 | 1/1919 | Matthews | 70/55 |
| 1,581,953 | 4/1926 | Jackson | 70/54 |
| 2,375,488 | 5/1945 | Olson | 70/54 X |
| 3,751,948 | 8/1973 | Klein | 70/55 |
| 3,835,675 | 9/1974 | Lippisch | 70/52 X |
| 3,888,096 | 6/1975 | Huss | 70/209 |
| 3,983,725 | 10/1976 | Manuel | 70/55 |
| 4,218,902 | 8/1980 | Druschel | 70/55 |
| 4,224,813 | 9/1980 | Hampton | 70/55 X |
| 4,226,100 | 10/1980 | Hampton et al. | 70/55 X |
| 4,297,861 | 4/1981 | Dykes | 70/55 |
| 4,799,369 | 1/1989 | Goodson et al. | 70/54 |
| 4,819,465 | 4/1989 | Stanich | 70/54 X |

FOREIGN PATENT DOCUMENTS

| | | | |
|---|---|---|---|
| 154804 | 5/1938 | Austria | 70/55 |
| 156072 | 12/1938 | Austria | 70/55 |
| 344118 | 11/1921 | Fed. Rep. of Germany | 70/55 |
| 203530 | 9/1923 | United Kingdom | 70/55 |

*Primary Examiner*—Robert L. Wolfe
*Assistant Examiner*—Suzanne L. Dino
*Attorney, Agent, or Firm*—Charles C. Corbin

[57] ABSTRACT

A security and protective cover for a padlock, which cover is releasably latchable to the padlock to cover the padlock case including keyway, and to shield the padlock shackle, is disclosed. There is a first cover portion having a lower part with spaced apart walls that form a case-receiving chamber with an open front to allow placement of the padlock case therein, with a top chamber wall having a spaced pair of semi-circular indentations for receiving the shafts of the shackle. Extending upwardly from the top of the lower part of the first cover portion is a shackle-shielding wall with a central slot extending downwardly from its top to define twin wall projections lying behind and adjacent the upstanding shackle shafts of a padlock mounted in the cover to surround first portions of these shafts. There is a second cover portion having a major wall with a lower end that is hingedly attached to the bottom of the first cover portion, and at the upper end of the major wall is a wall with twin semi-circular indentations. Above this wall is a shackle shielding portion with twin projections bordering a central slot, and key-operated latching means mounted just below the slot. With a padlock received in the first cover portion, the second portion is rotatable into full latchable engagement with the first portion, to cover all sides of the padlock case and to surround other portions of the shackle shafts.

9 Claims, 2 Drawing Sheets

LOCKABLE SECURITY COVER FOR A PADLOCK

BACKGROUND

1. Field of the Invention:

The present invention relates generally to a protective cover for a padlock, and more particularly to a lockable security cover which can releaseably envelop a padlock case as well as partially surround the padlock shackle.

2. Prior Art:

Although padlocks are used extensively to provide a measure of security, they ordinarily will not suffice where a higher level of security is required. In most applications a common padlock shackle remains vulnerable to being severed by a cutting tool, and it is well known that metal cutting shears can be used to cut a padlock shackle. In addition, the conventional padlock is susceptible to tampering by tools designed to fit into the padlock keyway.

There are available covers for padlocks, however, these are constructions primarily designed for shielding the padlock case from the effects of weather, and where a keyway cover is included it cannot be locked in place. One development towards greater security in padlocks is expressed in U.S. Pat. No. 3,835,675, to Lippisch. Such padlocks have the advantage brought by extended wall portions at the top of the case which partially enclose the shackle legs to shield them from tampering. A major security flaw remains with such devices since access to the keyway is not prevented. In addition, such massive padlocks are often expensive.

There is a vast number of conventional padlocks of simple design commercially available and relatively inexpensive. If add-on means can be provided to greatly increase the security of these locks and the security of the numbers of common inexpensive padlocks already in use, then the option is given to the consumer to greatly improve existing padlock security in a relatively inexpensive manner.

SUMMARY OF THE INVENTION

In view of the foregoing it is an object of the present invention to provide a security cover that can be easily releasably locked over a standard padlock case so as to block access to the case and keyway, as well as to shield the shackle.

Another object of the invention is to provide a padlock cover that shields against weather as well as giving added security.

A further object is to provide a security padlock cover that is key operated.

A still further object is to provide a protective cover for padlock case and shackle that can be applied to the padlock when the padlock is in locking use.

These and other objects and additional advantages will be provided by the security cover of the present invention which employs a first jacket portion that is hingedly attached to a second jacket portion. The first portion is adapted to cradle the padlock and the second portion is foldable to join the first portion to shield the case and shackle. The first jacket portion has a lower part with a top wall, rear wall, spaced apart side walls and a bottom wall portion, which walls form a compartment with an open front for receiving the case of a padlock. The top wall has spaced apart semi-circular indentations for receiving the shafts of the shackle. The upper part of the first jacket portion features a pair of upward projections that partially surround first portions of the shackle shafts, and a central slot lies therebetween.

The second jacket portion has a major wall which hingedly attaches at its lower end to the bottom wall portion of the first jacket portion, and has an upper wall with spaced semi-circular indentations for receiving the shafts of the shackle. At the top of this second jacket portion is a spaced pair of upward projections and a slot therebetween. The inventive structure is such that the second jacket portion may be folded into engagement with the first jacket portion, which has received therein a padlock to be covered, so as to cover all sides of the padlock case and to cause the upward projections on the second jacket to partially surround other portions of the shackle shafts. Key-controlled latching means is mounted centrally on the upper part of the second jacket and may engage latch accepting structure on the first jacket to lock the jackets together.

DETAILED DESCRIPTION OF THE INVENTION

Figure 1:
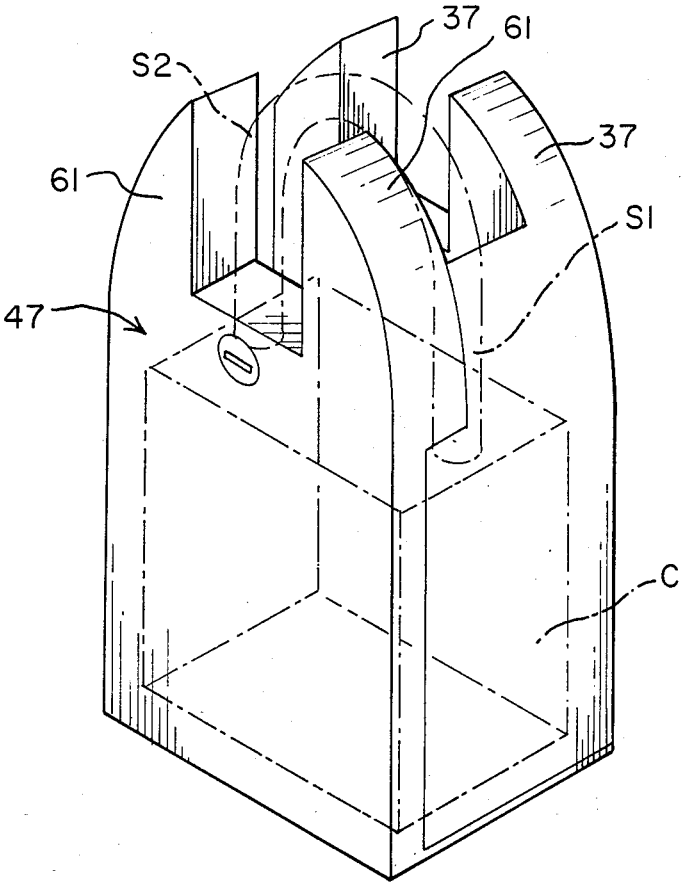
FIG. 1 is a perspective view showing a security cover according to the present invention applied to a conventional padlock.
Figure 2:
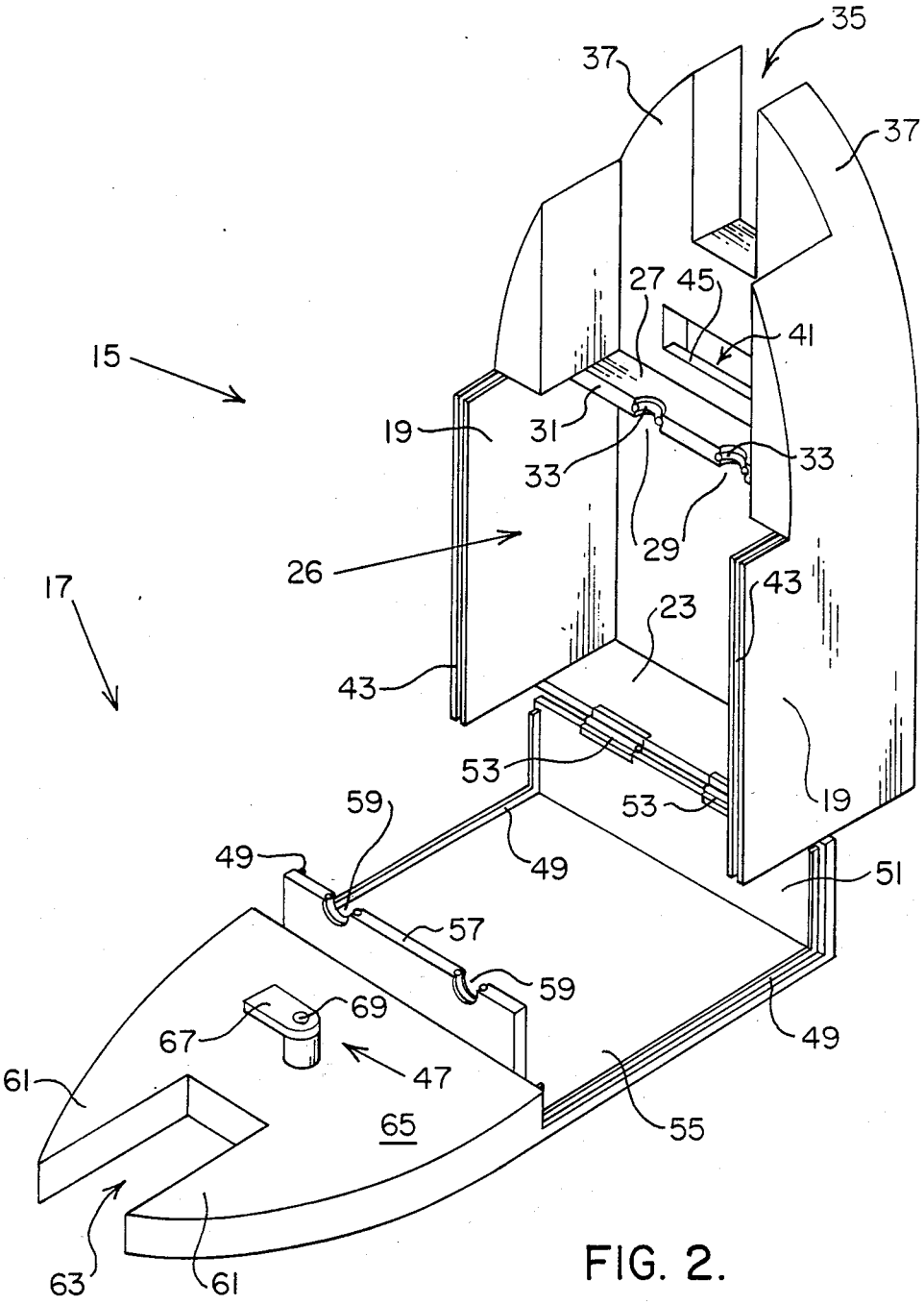
FIG. 2 is a perspective view showing the opened configuration of a padlock cover according to the present invention.

Referring now to the drawings, FIG. 1 illustrates a security cover 11 according to the invention applied to a conventional padlock that has a case C and a shackle with shafts S1 and S2. FIG. 2 shows the main components of the inventive cover 11, which is preferably made of a hard, strong polymeric material and which may also be fabricated of metal, to comprise a first jacket piece 15 and second jacket piece 17. The first piece 15 features spaced apart side walls 19, rear wall 21, and bottom wall portion 23. There is an upper wall 27 with spaced apart half-bores 29 lying in the forward edge 31 thereof. Note that in this preferred embodiment there are rubber-like segments 33 bonded within the half-bores 39. The aforementioned walls may be said to define a compartment 26 that is adapted to receive the case C with shackle shafts S1 and S2 lying in the half-bores 29. The twin upward projections 37 span a central slot 35 and are structured so as to surround a substantial portion of the shafts S1 and S2 of a padlock mounted to piece 15. A central cavity 41 is adapted to accommodate the projecting latch portion of a key-operated cam lock 47, mounted in the second piece 17. A latching ledge 45 with a surface (not shown) that extends downwardly therefrom adjoins cavity 41. As shown in FIG. 2 edges of side walls 19 are provided with grooves 43.

Jacket piece 17 has a lower wall portion 51 that is connected to the first piece 15 by conventional hinges at 53 for rotation about a horizontal axis. A major wall 55 extends towards an upper wall 57 that contains a pair of semi-bores 59 having constructions complementary to the semi-bores 39 in first piece 15. Note the ridges 49 extending along the lower wall 51, major wall 55, and upper wall 57. These ridges are adapted to form a tongue-and-groove fit with grooves 43 on walls 19 when pieces 15 and 17 are engaged for latching in a manner to be described. Finally the second piece 17 has a pair of projections 61, spanning a central slot 63. Note that the portion of cam lock 47 that projects from surface 65 includes a cam arm 67 that can with the use of a key in the ordinary manner for cam locks, be rotated about an axis through a pin 69.

When it is desired to apply cover 11 to a padlock, it is opened to a configuration such as shown in FIG. 2 to allow first piece 15 to be manipulated over the padlock so that the padlock case is received in compartment 26 with its shackle shafts cradled in the semi-bores 29. It is to be noted that in this manner the case 15 may receive a conventional padlock that has its shackle locked and securing an article, thus it will be seen that the inventive cover may be advantageously applied to a locked-in-place inexpensive padlock to greatly upgrade the security of that lock. With padlock received in compartment 26, the second piece 17 may then be rotated into full contact with piece 15. When the cam arm 67 is received in the central cavity 41, it may then be rotated by the turning of a key (not shown) to make latching engagement with the surface behind the latching ledge 45. This latched configuration is illustrated in FIG. 1, wherein shackle shafts S1 and S2 are substantially surrounded and shielded by the projecting pairs 37 and 61. In this configuration access to the padlock keyway is completely blocked. It is also noted that in this configuration the semi-bores 29 and 59 come together to embrace the shackle shafts in a weatherproofing manner by virtue of engagement of the rubber-like segments. Further weatherproofing and sealing of the two joined pieces 15 and 17 is provided in a preferred embodiment by the provision of a tongue or raised edge portion on piece 17 and corresponding mating grooves along the piece 15.

While a particular embodiment of the invention has been described herein it is not intended that the invention be limited thereto, since various modifications and changes may readily occur to those skilled in the art without departing from the invention. Therefore it is aimed to cover all such changes and modifications as fall within the true spirit and scope of the invention as described in the claims which follow.

What is claimed is:

1. Security cover for a padlock, for covering the padlock case and shielding the padlock shackle, said cover comprising:

(a) first cover portion having a lower part with top wall, spaced apart side walls, rear wall and bottom wall portion that form a compartment with open front for receiving therein said case with two spaced apart indentations in said top wall for receiving the shafts of said shackle, said first cover portion having an upper part including a matching pair of upward projections from the top of said lower part which projections surround first sides of said shackle shafts for protecting said shackle shafts, and an open-topped slot between said projections;

(b) second cover portion having a major wall with a lower end hingedly mounted to the bottom wall of said first cover portion and an upper wall at the top of said major wall with a pair of indentations for receiving said shackle shafts, and an upper portion to said second cover having a pair of upward projections bordering a central slot and key-operated latching means mounted in said second cover upper portion, said second cover being rotatable into engagement with said first cover portion so as to cover all sides of said case and with the upward projections of said first cover portion engaging the upward projections of said first cover portion such that the first and second cover portions surround and protect said shackle shafts and said latching means engageable with said first cover portion to hold said first and second cover portions in engagement.

2. Cover as defined in claim 1 wherein said first cover portion is adapted to make sealing engagment with said second cover portion when said portions are latched together.

3. Cover as defined in claim 1 wherein said major wall is adapted to make moisture sealing engagement with said case receiving compartment.

4. Cover as defined in claim 1 wherein edge portions of said first cover portion and edge portions of said second cover portion are adapted to engage each other in tongue-and-groove relationship.

5. Cover as defined in claim 1 wherein said latch means includes a pivotable cam arm that engages a cam receiving ledge on said first cover portion.

6. Cover as defined in claim 1 wherein said shackle receiving indentation in said first cover portion and in said second cover portion are semi-circular and have rubber-like linings for making sealing contact with said shackle shafts.

7. Cover as defined in claim 1 wherein said upward projections on said first and second covers are constructed of metal.

8. Cover as defined in claim 1, wherein the upward projections on said first cover portion surrounds said shackle shafts on three sides.

9. Cover as defined in claim 1, wherein said upward projections on said first cover portion and said upward projections on said second cover portion extend upwards substantially relative to said shackle.

* * * * *